United States Patent [19]

Lopez

[11] Patent Number: 4,691,387

[45] Date of Patent: Sep. 8, 1987

[54] GLOVE APPARATUS

[75] Inventor: Lionel P. Lopez, Houston, Tex.

[73] Assignee: Lion's Sports, Inc., Houston, Tex.

[21] Appl. No.: 658,610

[22] Filed: Oct. 9, 1984

[51] Int. Cl.[4] ..... A41D 19/00

[52] U.S. Cl. ..... 2/161 A; 2/160; 2/159; 2/DIG. 6

[58] Field of Search ..... 2/161 A, 161 R, 160, 2/159, DIG. 6, 16, 19

[56] References Cited

U.S. PATENT DOCUMENTS

| | | | |
|---|---|---|---|
| 2,465,136 | 3/1949 | Troccoli | 2/161 A |
| 3,368,811 | 2/1968 | Finney | 2/159 X |
| 3,508,280 | 4/1970 | Osborn | 2/159 |
| 3,532,344 | 10/1970 | Masstab | 2/161 A X |
| 3,597,765 | 8/1971 | Stanton | 2/161 A X |
| 4,042,975 | 8/1977 | Elliot et al. | 2/161 A X |
| 4,400,831 | 8/1983 | Rietz | 2/161 A |
| 4,414,692 | 11/1983 | Dzierson et al. | 2/160 |
| 4,420,843 | 12/1983 | Genzling et al. | 2/161 A |

FOREIGN PATENT DOCUMENTS

| | | | |
|---|---|---|---|
| 2807658 | 9/1979 | Fed. Rep. of Germany | 2/161 A |
| 547946 | 9/1942 | United Kingdom | 2/161 A |
| 2080672 | 2/1982 | United Kingdom | 2/159 |

*Primary Examiner*—Werner H. Schroeder
*Assistant Examiner*—J. L. Olds
*Attorney, Agent, or Firm*—Alton W. Payne

[57] ABSTRACT

An athletic glove apparatus for providing a non-slip grip and for providing padding and protection to the hand and the various areas of impact for use in different sports. A baseball glove apparatus comprises a glove and a bat wrap, the glove comprising a palm truss, a thumb truss a lower finger truss on each finger and a pad such that the bat wrap engages the truss members. A water sport glove comprises a glove and a ski handle, the glove comprising a palm truss, a thumb truss, a lower finger truss on each finger, an intermediate finger truss on each finger and an outer finger truss on the middle two fingers, the ski handle comprising a handle wrap that acts with the truss members to provide a secure, padded grip. A weight lifting glove comprising a glove and a wrap member, the glove comprising a palm truss, a lower finger truss on each finger, an intermediate finger truss on each finger and a palm pad, such that the wrap member actively engages the truss members for providing a non-slip, padded grip. A golf glove apparatus comprising a glove and a grip member, the glove comprising a palm truss and a lower finger truss on three fingers, such that the grip member actively engages the truss members to provide a non-slip, padded grip. A cycling glove apparatus comprising a glove and a handle bar wrap, the glove comprising a palm truss, an upper palm pad, a lower palm pad and a thumb pad, such that the handler bar wrap actively engages the truss member and the pad members for providing a padded, non-slip grip that is exceedingly easy to disengage.

32 Claims, 12 Drawing Figures

100
102
104
106
106
108

110
100

200
210
210
202
206
208

200
212
214

300
302
304
306
308

300
310

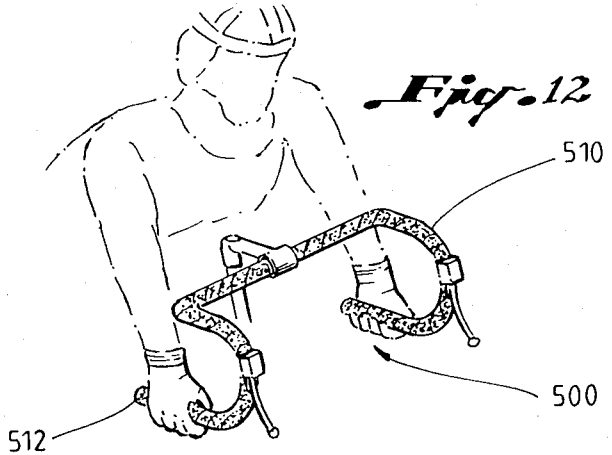
Fig. 12
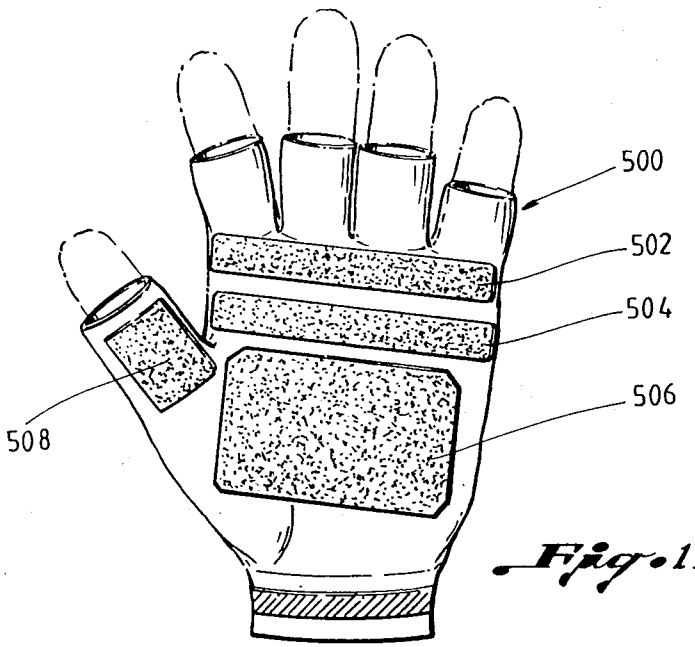
Fig. 11
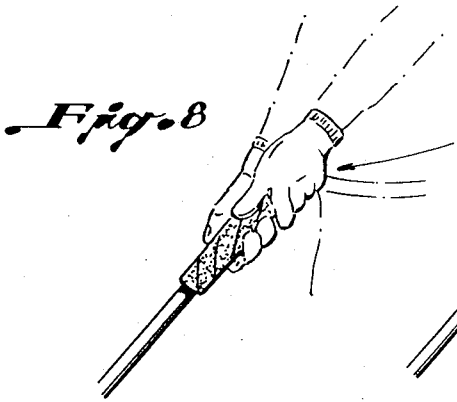
Fig. 8
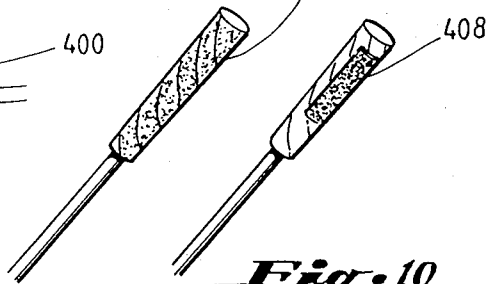
Fig. 9
Fig. 10
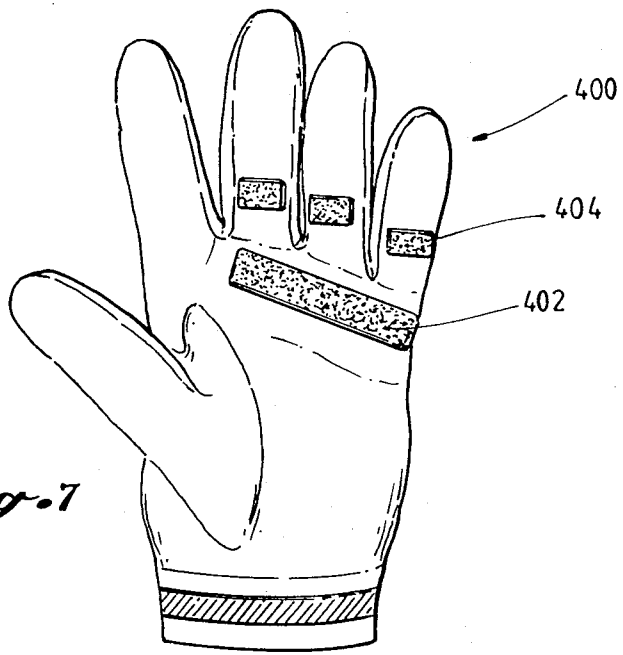
Fig. 7

GLOVE APPARATUS

FIELD OF THE INVENTION

The present invention relates generally to securing objects in the hand of a person. Specifically, the present invention relates to a glove apparatus which provides a conduit through which the power or strength of the wearer can be transmitted and directed by increasing the strength of the grip without exerting additional energy and thereby redirecting the available power for the more efficient use of the glove.

BACKGROUND OF THE INVENTION

The use of gloves of all types is well known for work as well as sports. Typically, gloves are used to provide enhanced handling characteristics and to protect the hand. However, as the enhancements and protection are increased, the dexterity is typically reduced. Gloves of all types are in the public domain. Types of gloves vary from those which provide a basic cloth covering for the hand to those which include very complicated mechanical fixtures.

One of the basic problems confronted when using gloves or other types of hand gear is that the glove tends to slip on the surface which is being grasp. Such slippage can cause the glove to become ineffective for many uses. There has been considerable effort to try to prevent the slippage between the glove and the object being grasped.

An early method of minimizing the slippage between a glove and the object embraced is by using an intermediate material. The intermediate material is used between the glove and the embraced object, which increases the coefficient of friction and, therefore, minimizes slippage. Typically, an abrasive material or any material having a higher coefficient of friction is placed on the surface of the glove or on the surface of the embraced object. The added material causes more drag between the glove and the embraced object. For example, small beads of plastic may be melted into a cloth glove to provide a higher coefficient of friction between the cloth glove and a handle being grasped.

The prior art has utilized a glove device which incorporates a first type of material on the surface of the glove and a second type of material on the surface of the object embraced. The two different types of material act together to provide a non-slip grip. Attention is drawn to U.S. Pat. No. 3,368,811, which issued Feb. 13, 1968 to Basil B. Finney. The Finney patent utilizes VELCRO fastener material. VELCRO fastener material comprises a hook material and a loop material which mesh together engaging the hooks and the loops. The hook and loop engagement provides a fixed unison between the two materials. The restriction of movement for VELCRO fastener material is strongest in the plane parallel to the interface of the two materials. Thus, slippage may be impossible in the plane of the interface of the VELCRO materials, but a quick, easy release of the materials is not typically possible. Most gloves require not only a strong, secure grip, but also a quick, easy disengagement without extra effort and without hindering the dexterity of the hands or fingers.

It has also been a characteristic of the prior art to try to provide a glove that inhibits or prevents damage to the hand. Therefore, there are different types of gloves for different types of uses. A baseball glove is typically quite different from a weightlifting glove or a cycling glove. Likewise, a glove used in the water is quite different from any of the previously mentioned gloves.

Typically, gloves are used to provide a single feature. The provided feature may be a no-slip interface, extra padding for the hand, protection for the hand or a means of shock absorption for the hand. Even when a glove is adapted to provide a specific function, typically, the approach has been to provide a general purpose glove directed to that specific function. For example, if a glove were to be used to protect the hand, the glove would be designed with padding on all areas of the hand. Likewise, if the glove were designed to prevent slippage between the glove and the object grasped, the intermediate material having a higher coefficient of friction would be placed on the entire gripping surface of the glove.

Very little effort has been directed toward developing gloves which provide enhanced use and protection characteristics without hindering the dexterity of the user. Typical glove construction causes a reduction in the dexterity of the user. As a general rule, the dexterity and the sensitivity associated with a glove are inversely proportional to the padding and protection of the glove. Thus, as the padding and protection are increased in the typical glove, the dexterity and sensitivity of the user are decreased.

Typically, gloves have not been used to enhance the skill of the wearer. Gloves are commonly used to prevent slipping or for protection. None of the presently known uses for gloves reduces muscle strain or muscle fatigue. If a glove could aid in reducing the effort required by the hand and arm in securing a grip, then the unused portion of strength can be utilized as readily available power.

There is thus a need for an athletic glove and related apparatus that are designed specifically to be used for a particular purpose, which, provides a secure, no-slip grip, which, at the same time, provides a quick, easy release, which provides extra padding, protection and shock absorption without hindering the dexterity of the user, and which provides a conduit through which power can be transmitted and directed, thereby making available additional energy for the more efficient use of the glove.

It is, therefore, a feature of the present invention to provide a unique glove apparatus for utilization in specific sports which provides enhanced playing characteristics as well as hand protection in each of the sports.

It is a more particular feature of the present invention to provide a glove apparatus and associated equipment which acts as a conduit through which power can be transmitted and directed by increasing the strength of the grip without exerting additional energy and thereby redirecting the available power for the more efficient use of a glove.

Another feature of the present invention is to provide a glove apparatus for controlling the slippage of the embraced object and the surface of the glove during use and which provides a quick, easy disengagement of the glove from the embraced object.

Yet another feature of the present invention is to provide a glove apparatus which has extra padding, protection and shock absorbing means for protecting and preventing damage to the hand.

Yet still another feature of the present invention is to provide a glove apparatus that prevents blisters by absorbing friction evenly throughout the portions of the hand most vulnerable to friction.

A further feature of the present invention is to provide a glove apparatus for increasing the strength of the grip without the exertion of additional force in securing the grip.

Still further a feature of the present invention is to provide a glove apparatus to increase the sensitivity of the hand-grip interface by requiring that less physical exertion be utilized to maintain a secure grip.

Still further a feature of the present invention is to provide a glove apparatus to prevent excessive shock to the hands by providing cushion and padding to the impacted pressure areas of the hand.

Another feature of the present invention is to provide a glove apparatus to reduce muscle strain and muscle fatigue by reducing the effort required in providing a secure grip and, therefore, providing additional strength in the hands and arms of the user.

Yet another feature of the present invention is to provide a glove apparatus having a more durable surface in contact with the points of abrasion, wear and friction for providing a more durable contact surface for a glove with a longer usable life.

Yet still another feature of the present invention is to provide a glove apparatus to be used specifically in, but not limited to, each of the sports of baseball, weightlifting, cycling, golf and water sports.

Additional features and advantages of the invention will be set forth in part in the description which follows, and in part will become apparent from the description, or may be learned by practice of the invention. The features and advantages of the invention may be realized by means of the combinations particularly pointed out in the appended claims.

SUMMARY OF THE INVENTION

In accordance with the present invention, a unique glove apparatus are provided for a quick, easy release and a sure no-slip grip which provides a conduit for power to be transmitted and directed for more efficient use by the glove increasing the strength of the grip without exerting additional strength. In one embodiment of the invention, a glove apparatus is provided comprising a plurality of truss elements fixidly engaged with a glove such that the glove can be easily and readily disengaged from a truss-receptive handle and the truss elements provide sufficient engagement with truss-receptive handle to prevent the slippage of the handle within the glove.

It is preferable that the glove apparatus of the present invention which is used in the sport of baseball comprises: a palm truss across the upper palm region of the hand, an angular thumb truss located at the base of the thumb, a lower finger truss associated with each finger and a side pad opposite the thumb which react with a truss-receptive bat handle. Additionally, the baseball glove apparatus can be used in conjunction with a typical bat having a rubber or wood handle as well as a bat specifically adapted with a truss-receptive handle.

More specifically, the baseball glove comprises: a palm truss across the head of the second through the fifth metacarpal, a thumb truss between the proximal phalanx of the thumb and the head of the first metacarpal having the shape of a right angle with the thumb oriented at the interior of the right angle, a lower finger truss across the proximal phalanx of each finger and a pad on the outer, lower portion of the palm for protecting the hypothenar muscle group and a truss-receptive bat handle, such that the palm truss, the thumb truss and the lower finger trusses comprise VELCRO hook material which acts in conjunction with VELCRO loop material or rubber on the handle of a bat to provide a surface fastener at each truss location.

It is preferable that the glove apparatus used in water sports be used in association with loop tape being engaged with the components which are to be grasped while using the glove apparatus, the water sport glove apparatus comprising: a palm truss thereupon covering the head of the second through the third metacarpal, a thumb truss thereupon located between the proximal phalanx and the distal phalanx of the thumb, a lower finger truss covering a portion of the proximal phalanx of each finger, an intermediate finger truss covering a portion of the middle phalanx of each finger and an outer finger truss covering the distal phalanx of the middle and fourth fingers of each hand and a truss-receptive member to be embraced. More specifically, in one particular embodiment each of the truss elements comprises VELCRO hook material for acting in conjunction with VELCRO looped material upon the object to be embraced for creating a hook-loop fastener at the location of each truss.

Preferably, the glove apparatus for weightlifting is used in conjunction with VELCRO loop tape or the like, which is engaged with the weight or weights lifted, the weightlifting glove apparatus comprises: a palm truss thereupon which covers the head of the second through the fifth metacarpal, a lower finger truss thereupon which covers the proximal phalanx of each finger, an intermediate finger truss thereupon which covers the middle phalanx of each finger and a palm pad thereupon covering both the superificial palmar arch and the deep palmar arch, such that each truss member is comprised of hook material or the like which actively secures with the loop material or the like on the weights for providing a secure grip when lifting the weights.

Preferably, the glove apparatus for use in golf comprises a palm truss thereupon covering the head of the third, fourth and fifth metacarpal comprising VELCRO hook fastener material or the like, a lower finger truss thereupon across the shaft of the proximal phalanx of the middle, third and fourth finger comprising VELCRO hook fastener material or the like and a grip associated with the golf club comprising loop fastener material or the like, such that, the hook fastener material of each truss interacts with the loop fastener material of the grip to provide a secure non-slip grip with a quick, easy release for providing a conduit through which power can be transmitted by increasing the strength of the grip without exerting additional energy and thereby redirecting the available power for more efficient use.

In accordance with another preferred embodiment of the present invention, a glove apparatus is provided for use in cycling which comprises: a cycling glove comprising a palm truss across the head of the second through the fifth metacarpal, an upper palm pad covering the proximal transverse of the palm, a lower palm pad covering the deep palmar arch from the thenar eminence to the hypothenar muscle group, a thumb pad covering the proximal phalanx and part of the distal phalanx of the thumb and a handle bar wrap comprising loop fastener material or the like for engaging with the palm truss to provide a sure grip that is readily releasable.

Any truss-type material is appropriate to provide the enhanced features of the present invention. Any truss material which provides, in association with specific parts of the hand, a removable secured grip is appropriate for use.

BRIEF DESCRIPTION OF THE DRAWINGS

The accompanying drawings which are incorporated in and constitute a part of the specification, illustrate a preferred embodiment of the invention and, together with the general description of the invention given above, and the detailed description of the preferred embodiment given below, serve to explain the principles of the invention.

FIG. 7 is a perspective view of a preferred embodiment of the glove apparatus of the present invention adapted for use in golf;

FIG. 8 is a perspective view of the glove apparatus of the present invention illustrating the use thereof with a golf club;

FIG. 9 illustrates the handle of a golf club that has been covered with a loop fastener material or the like for use with the golf glove of the present invention;

FIG. 10 illustrates an embodiment of the handle of a golf club which has been adapted with a loop fastener material or the like for use with the golf glove of the present invention;

FIG. 11 is a perspective view of a preferred embodiment of the glove apparatus of the present invention adapted for use in cycling; and FIG. 12 is a perspective view illustrating the use of the glove apparatus of the present invention in cycling.

Figures 1, 2, 3, 4, 5, 6:
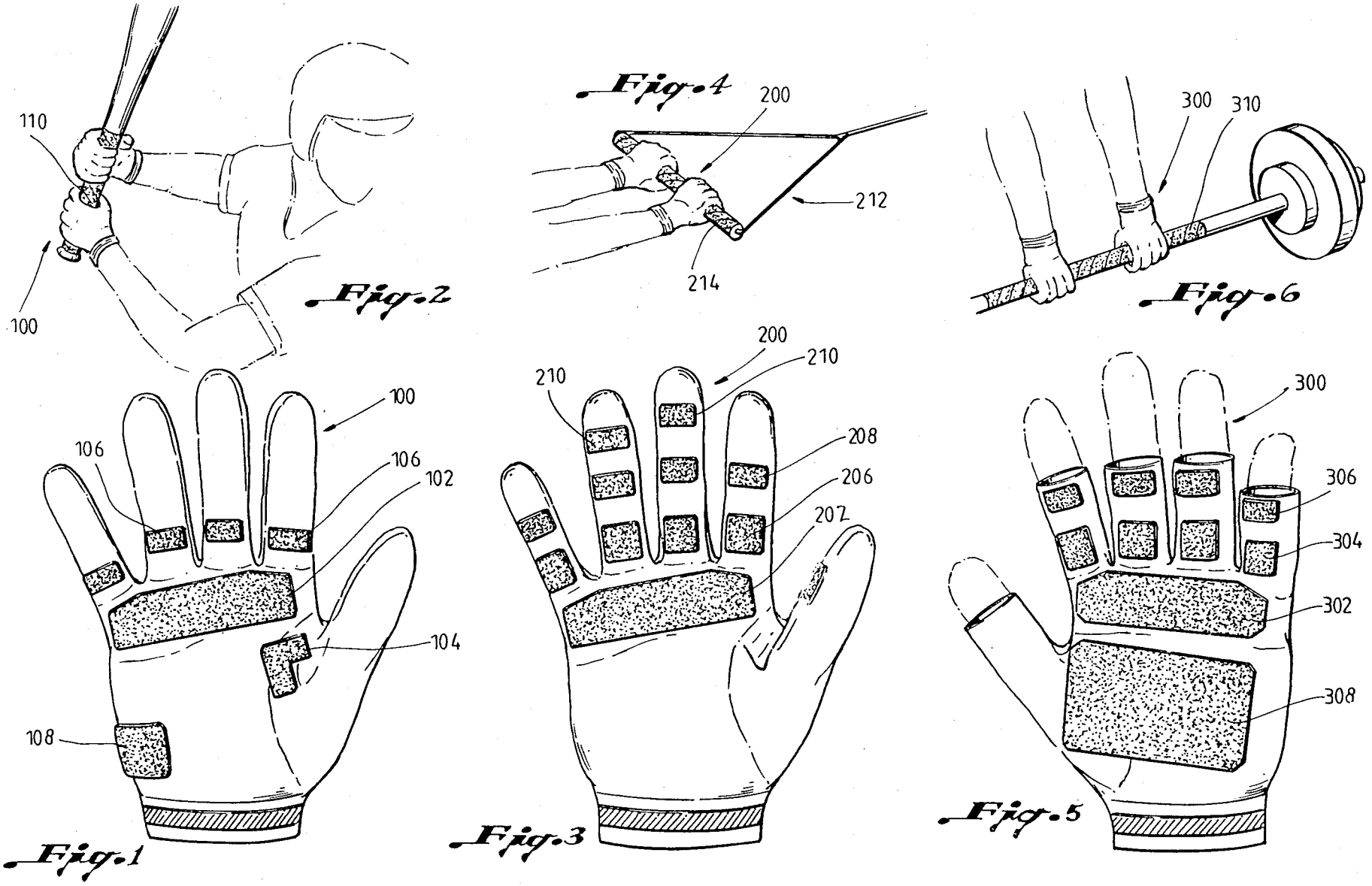
FIG. 1 is a perspective view of a preferred embodiment of the glove apparatus of the present invention adapted for use in the sport of baseball.
FIG. 2 is a perspective view of the glove apparatus of the present invention adapted for use and being used in the sport of baseball.
FIG. 3 is a perspective view of a preferred embodiment of the glove apparatus of the present invention adapted for use in water sports.
FIG. 4 is a perspective view of the glove apparatus of the present invention used in conjunction with a ski handle.
FIG. 5 is a perspective view a preferred embodiment of the glove apparatus of the present invention adapted for use in weightlifting.
FIG. 6 is a perspective view of the glove apparatus of the present invention used in conjunction with a barbell.

The above general description and the following detailed description are merely illustrative of the generic invention, and additional modes, advantages and particulars of this invention will be readily suggested to those skilled in the art by the following detailed description.

DETAILED DESCRIPTION OF THE PREFERRED EMBODIMENT

Reference will now be made in detail to the presently preferred embodiments of the invention as illustrated in the accompanying drawings.

FIGS. 1 and 2 illustrate perspective views of a preferred embodiment of the glove apparatus of the present invention for use in the sport of baseball. FIG. 1 illustrates a baseball glove 100 which can be made of any suitable material, for example, sheepskin leather. On the palm of the glove 100 is sewn a palm truss 102. The palm truss 102 covers the upper portion of the palm and passes across the head of the second, third, fourth and fifth metacarpal bone of the hand. Preferably, the palm truss 102 is made of hook fastener material or the like. The hook fastener material can be VELCRO brand or a means for providing characteristics similar to those of VELCRO fasteners. The palm truss 102 is used as a securing mechanism to provide a no-slip grasp, but is also used to cover and protect the palmer ligament, metacarpophalangeal joint and the flexor tendon. The palm truss 102 can have different dimensions depending on the size of the hand of the person who is going to use the glove 100. However, it has been found that a standard size of approximately 1 inch by $1\frac{1}{4}$ inch is readily useful in most situations.

Also illustrated in FIG. 1 is the thumb truss 104 on the glove 100. The thumb truss 104 is placed on the glove 100 to lie between the thenar eminence and the base of the thumb, i.e., between the proximal phalanx of the thumb and the head of the first metacarpal. The thumb truss 104 is in a very high friction area when gripping a baseball bat. Preferably, the thumb truss 104 is made of hook fastener material or the like. For example, the thumb truss 104 can be made of VELCRO woven nylon hook material. The dimensions of the thumb truss 104 depend on the size of the hand of the user of the glove 100. The dimensions of the thumb truss 104 have been found to be adaptable to most hand sizes are a 1 inch by 1 inch square with a $\frac{1}{2}$ inch square cut from one of the corners.

The lower finger trusses 106 are illustrated just above the palm truss 102 in FIG. 1. Each lower finger truss 106 is affixed to the glove 100 to be aligned with the proximal phalanx of each finger. Preferably, each lower finger truss 106 is made of VELCRO woven nylon hook material or the like.

The intermediate finger trusses 107 are illustrated just above the lower finger trusses 106 in FIG. 1. Each intermediate finger truss 107 is affixed to the glove 100 to be aligned with the middle phalanx of each finger.

The pad 108 illustrated in FIG. 1 is used as protection and not to enhanced the grip of the glove. The pad 108 protects the hypothenar muscle group. The hypothenar muscle group includes the abductor digiti minimi, the hypothenar eminence, the palmaris brevis and other muscles. The pad 108 acts as a means for protecting the hand as well as provides durability and longevity for the glove 100.

FIG. 2 illustrates the bat wrap 110 being used in conjunction with the glove 100. The bat wrap 110 is made of "warped knit" material. The warped knit material is used in connection with and is similar to the VELCRO woven nylon loop material but is thinner. The thinner warped knit material provides that the radius of the bat around which it is wrapped is not significantly increased. Thus, using the warped knit bat wrap 110 has a more realistic "feel" than could be acquired using VELCRO-type material.

The palm truss 102 and each lower finger truss 106 act as a system for providing a non-slip grip. As the bat is held. Each lower finger truss 106 closely engages the palm truss 102. The palm truss 102, the thumb truss 104, each lower finger truss 106 and the bat wrap 110 act as a unit to provide a no-slip grip that is readily disengaged from the bat. The truss-wrap unit acts to stabilize the hand around the bat handle. The pad 108 is used to protect the hand and the glove 100. The knob of the bat rests on the pad 108. The pad 108 prevents the knob from causing accelerated wear to the glove. Each of the truss members 102, 104 and 106, as well as the pad 108, are located on the glove at points of excessive friction. The truss members 102, 104 and 106 and the pad 108 are specifically located at the friction points to prevent blisters and absorb shock transmitted to the hand.

In the presently preferred embodiment of the glove apparatus used in baseball, each of the truss members, 102, 104 and 106 are made of VELCRO woven nylon hook fasteners. More specifically, the hook fastener material is VELCRO #65 hook material. The VELCRO #65 hook material is designed for a maximum number of engagements which provides for an increased peel cycle like. Preferably, the pad 108 on the glove 100 comprises VELCRO woven nylon loop material. The loop material used is VELCRO loop #1000 material. It should be noted that, although the pad 108 is preferably made of VELCRO material, the pad 108 is not used as a fastener mechanism. The pad 108 is used to protect the hand, prevent the excessive wear of the glove, enhance the total grip of the glove mechanism and the like.

FIGS. 3 and 4 illustrate the use of the glove apparatus of the present invention as an enhancement to water sports. Generally, the glove apparatus of the present invention used for water sports comprises the water sport glove 200 as illustrated in FIGS. 3 and 4 as well as the ski handle 212 illustrated in FIG. 4.

FIG. 3 illustrates the water sport glove 200 of the present invention. The water sport glove 200 of the present invention comprises the palm truss 202, a lower finger truss 206 on each finger, an intermediate finger truss 208 on each finger and an outer finger truss 210 on the middle two fingers. The ski handle 212 has as a basic component of the present invention a handle wrap 214 which actively engages the truss material associated with the glove 200.

In FIG. 3, the palm truss 202 is fixedly attached to the glove 200. The palm truss 202 covers the area of the palm which is associated with the head of the second, third, fourth and fifth metacarpal bones. It is preferred that the palm truss 202 be made of VELCRO woven nylon hook material. Specifically, it is preferred to use the VELCRO hook #80 material. The hook #80 material provides for a greater sheer strength when the hook material is engaged with loop material. Though the size of the palm truss 202 may vary with the size of the user's hand, it has been found that a size of approximately 1 inch by approximately $1\frac{3}{4}$ inch is satisfactory for most applications of the glove 200.

FIG. 3 illustrates the use of a lower finger truss 206 on each finger of the hand. Each lower finger truss 206 is placed across the shaft of the proximal phalanx of each finger. Each lower finger truss 206 is preferably made of VELCRO hook #80 fastener material. It has been found that each lower finger truss 206 is quite effective for average use with the glove 200 when it is approximately $\frac{5}{8}$ inch by approximately $\frac{3}{4}$ inch.

The intermediate finger trusses 208 are illustrated in FIG. 3. The intermediate finger truss 208 is placed across the shaft of the middle phalanx of each finger. Each intermediate finger truss 208 is made of VELCRO hook #80 fastener material. It has also been found that an adequate size for the intermediate finger truss 208 is approximately $\frac{5}{8}$ inch by approximately $\frac{3}{4}$ inch. Other sizes for the intermediate finger truss 208 could depend on the size of the user's hand or on the strength of the grip required.

An outer finger truss 210 is associated with the glove 200 for the middle two fingers. The outer finger truss 210 is oriented on the glove 200 to cover the shaft of the distal phalanx of each finger. The outer finger truss 210 is preferably made of VELCRO woven nylon hook #80 material. Additionally, the outer finger truss 210 has the dimensions of approximately $\frac{5}{8}$ inch by approximately $\frac{3}{8}$ inch.

FIG. 4 illustrates the use of the glove 200 with the ski handle 212. The portion of the ski handle 212 that comes into contact with the glove 200 is covered with the handle wrap 214. The handle wrap 214 is preferably made of VELCRO woven nylon hook #1000 material. The VELCRO loop #1000 material engages with and secures to the VELCRO hook #80 material of each of the truss members.

The water sport glove 200 and the ski handle 212 are designed to prevent the handle 212 from being disengaged with the glove 200. In most situations, the finger area is placed under great stress. Also, the finger and upper palm areas are most vulnerable to blisters and other hand damage. The truss material provides a sure grip as well as covers and protects the hand. Some of the special features of the glove 200 are the increased surface area of the VELCRO material on the fingers which aids in providing a steady non-slip grip. The location and quantity of the VELCRO material enhances the sensitivity and increases the padding associated with the glove 200.

FIGS. 5 and 6 illustrate the glove apparatus of the present invention as used in weightlifting. The glove apparatus of the present invention comprises the combination of the weightlifting glove 300 and the stantion wrap 310. The glove 300 comprises the palm truss 302, the lower finger trusses 304, the intermediate finger trusses 306 and the palm pad 308.

The palm truss 302 as illustrated in FIG. 5 is placed across the upper palm of the hand. Specifically, the palm truss 302 is placed across the head of the second, third, fourth and fifth metacarpal bones. The palm truss 302 is made of VELCRO woven nylon hook #65 material. Preferably, the palm truss 302 has the dimensions of approximately 1 inch by approximately $3\frac{1}{4}$ inch.

Each of the fingers in the glove 300 have thereupon a lower finger truss 304. The lower finger truss 304 is placed on the glove to cover the shaft of the proximal phalanx of each finger. The lower finger truss 304 has the dimensions of approximately $\frac{5}{8}$ inch by approximately $\frac{3}{4}$ inch. The lower finger truss 304 is made of VELCRO woven nylon hook #65 material.

Each finger compartment of the glove 300 has associated therewith an intermediate finger truss 306. The intermediate finger truss 306 is fixedly secured to the glove to cover the shaft of the middle phalanx of each finger. The intermediate finger truss 306 is made of VELCRO woven nylon hook #65 material. Preferably, the intermediate finger truss 306 has the dimensions of approximately $\frac{5}{8}$ inch by approximately $\frac{3}{8}$ inch.

The palm pad 308 of the glove 300 illustrated in FIG. 5. The palm pad 308 is sewn upon the glove 300 to cover both the superficial palmar arch and the deep palmar arch. The palm pad 308 is made of VELCRO woven nylon loop #1000 material. The palm pad 308 acts as a pad only and is not utilized to secure the grip of the glove.

FIG. 6 illustrates the use of the stantion wrap 310 and the glove 300. The stantion wrap 310 is made of VELCRO woven nylon loop #1000 tape material. The stantion strap 310 is wrapped around the stantion of the barbell as illustrated in FIG. 6.

The glove apparatus of the present invention can be utilized in weight training to prevent the barbell or related weights from slipping from the user's grasp. The present invention gives extra holding power whether the lifter is pulling or pushing during his exercise. The apparatus of the present invention has been found to be exceedingly good in training for pulling exercises such as curls, chin-ups and the like.

FIGS. 7, 8, 9 and 10 illustrate the glove apparatus of the present invention as used in the sport of golf. The glove apparatus of the present invention when used in golf comprises the glove 400 and the club grip 406 or the club strip 408.

The golf glove 400 of the present invention comprises the palm truss 402 and the three lower finger trusses 404. The palm truss 402 is affixed to the glove 400 to cover the head of the third, fourth and fifth metacarpal bones. The lower finger truss 404 associated with the third, fourth and fifth finger are affixed to the glove 400 to cover the shaft of the proximal phalanx of the middle, third and fourth finger. Both the palm truss 402 and each of the lower finger trusses 404 are preferably made of VELCRO woven nylon hook #65 material.

FIGS. 9 and 10 illustrate two examples by which the handle of a golf club can be implemented for use with the glove 400 of the present invention. In FIG. 9, the entire club grip 406 is made of "warped knit" material which is comprised of hundreds of small, soft loops which react to engage and secure the hook material used in the palm truss 402 and the lower finger truss 404 of the glove 400. Similarly, FIG. 10 illustrates a modification to a typical golf handle which provides that the present invention can be used therewith. The club strip 408 is fixedly secured to the golf handle. The club strip 408 comprises the warped knit material such as previously discussed.

To use the present invention in golf, the glove 400 can be used with any modified or built-in handle having material thereupon which engages and secures the truss members 402 and 404 of the glove 400. Thus, the club grip 406, the club strip 408 or the like can be used to engage the truss members 402 and 404.

Additionally, the glove 400 can be used with a lower, outer palm pad (not illustrated in FIG. 11) to augment the grip, protect the hand and preserve the life of the glove. The lower, outer palm pad (not illustrated) could be similar to that discussed above as the pad 108 in association with the baseball glove 100 of the present invention.

FIGS. 11 and 12 illustrate the use of the glove apparatus of the present invention in the sport of cycling. The glove apparatus of the present invention when used for cycling comprises the cycling glove 500 and the handle bar wrap 510. The cycling glove 500 comprises the palm truss 502, the upper palm pad 504, the lower palm pad 506 and the thumb pad 508. The pads 506 and 508 are illustrated in FIG. 11. The handle bar wrap 510 also comprises the endcaps 512.

As illustrated in FIG. 11, the palm truss 502 is fixedly attached to the glove 500 to position the palm truss 502 across the head of the second, third, fourth and fifth metacarpal bones. Preferably, the palm truss 502 comprises VELCRO woven nylon hook #65 material.

The upper palm pad 504, the lower palm pad 506, interior palm pad (not illustrated in FIG. 1) and the thumb pad 508 are fixedly secured to the glove 505. Each of the pads 504, 506 and 508 as well as the interior pad (not illustrated) are preferrably made of VELCRO woven nylon loop #1000 material. The upper palm pad 504 is attached to the glove 500 to cover the proximal transverse of the palm. The lower palm pad 506 of the glove 500 is attached thereto to cover the deep palmer arch from the thenar eminence to the hypothenar muscle group. The interior pad (not illustrated) coincides with the location of the lower palm pad 506 to provide double padding to the deep palmer arch. The thumb pad 508 is attached to the glove 500 to cover the proximal phalanx and part of the distal phalanx of the thumb.

The handle bar wrap 510 comprises VELCRO woven nylon loop #1000 fastener tape. The handle bar wrap 510 is wrapped completely around the handle bar as illustrated in FIG. 12. The handle bar wrap 510 is secured using the end caps 512.

The glove apparatus of the present invention for use in cycling provides protection and padding as well as a minimal amount of shearing resistance between the glove and the handle bar. The glove apparatus of the present invention for cycling provides a minimal amount of grip security and a maximum amount of grip padding. It should be noted that the enhanced padding effect is present when using the cycling glove 500 and the handle bar wrap 510 together or separately.

Typically, the mating strength of a VELCRO closure depends on the amount of pressure applied in effecting the closure. Vibration or movement of the fastening components, e.g., the truss material of VELCRO hook #65 or #80 material and the wrap material made of the VELCRO loop #1000 material or the "warped knit" material, as well as pressure will drive additional hooks into the loops, resulting in a stronger closure. Therefore, a better grip may be acquired with different usages of the glove apparatus of the present invention. Based upon the enhanced performance with vibration, movement, or pressure and the need for padding in specific areas of the glove, the glove apparatus of the present invention has various modifications which are required for use in each application.

Any truss-type material is appropriate to provide the enhanced features of the present invention. Truss material which provides, in association with specific parts of the hand, a removeably secure grip is appropriate for use. Although the presently referred embodiment specifically uses hook and loop fastener material, any other material which provides a removable, secured grip is appropriate. The present invention provides a removably secure grip based upon the location of the securing truss members relative to specific parts of the hand and more particularly the present invention is directed to the locations where the securing truss members are not located. Indeed, it is the combination of the locations where the securing truss members are located and where the truss members are not located relative to the specific parts of the hand that create the enhanced and innovative characteristics of the present invention.

Additional advantages and modifications will readily occur to those skilled in the art. The invention in its broader aspects is therefore not limited to the specific details, representative apparatus, and the illustrative example shown and described herein. Accordingly, departures may be made from the detail without departing from the spirit or the scope of the disclosed general inventive concept.

What is claimed is:

1. A glove apparatus for use with a baseball bat to provide the secure engagement of the hands with the bat comprising:

(a) one or two gloves for use with the hands, (b) a palm truss member fixedly secured to the upper portion of the palm of said glove but displaced from, and not associated with, the bending portions of the thumb and the palm, (c) a thumb truss member fixedly secured between the thumb and the palm of said glove but displaced from, and not associated with, the bending portions of the thumb and the palm, (d) a finger truss member fixedly secured at the lower portion of one or more fingers of said glove but displaced from, and not associated with, the bending portions of the thumb and the palm, (e) a pad fixedly secured to said glove for covering the lower, outer portion of the palm thereof, and (f) a truss-receptive member fixedly secured to the bat for removeably engaging said truss members for providing a no-slip grip between said glove and the bat, the glove apparatus for protecting the hand and for enhancing the sensitivity of the dexterity of the user.

2. A glove apparatus as defined in claim 1 wherein said palm truss member is aligned to cover the vicinity of the head of the second, third, fourth and fifth metacarpal bone of the hand but displaced from, and not associated with, the bending portions of the thumb and the palm.

3. A glove apparatus as defined in claim 1 wherein said thumb truss member comprises a member having an acute angle having a concaved portion and a convexed portion, the concaved portion positioned facing the thumb of said glove and the convexed portion positioned facing the palm such that said thumb truss member is displaced from, and not associated with the bending portions of the thumb and the palm.

4. A glove apparatus as defined in claim 3 wherein the acute angle of said thumb truss member comprises a right angle.

5. A glove apparatus as defined in claim 1 where said thumb truss member is aligned in the vicinity between the proximal phalanx of the thumb and the head of the first metacarpal bone of the hand but displaced from, and not associated with, the bending portions of the thumb and the palm.

6. A glove apparatus as defined in claim 1 where said finger truss member is aligned to cover the vicinity of the shaft of the proximal phalanx of each finger but displaced from, and not associated with, the bending portions of the fingers.

7. A glove apparatus as defined in claim 1 wherein said pad is aligned to cover the vicinity of the hypothenar muscle group.

8. A glove apparatus for use in water sports to provide the secure engagement of the hands with a ski handle or the like comprising:

(a) one or two gloves for use with the hands, (b) a palm truss member fixedly secured to the upper portion of the palm of said gloves but displaced from, and not associated with, the bending portions of the palm, (c) a lower finger truss member fixedly secured to the lower portion of one or more fingers of said gloves but displaced from, and not associated with, the bending portions of the fingers, (d) an intermediate finger truss member fixedly secured to the middle portion of one or more fingers of said gloves but displaced from, and not associated with, the bending portions of the fingers, (e) an outer finger truss member fixedly secured to the outer portion of one or more fingers of said gloves but displaced from, and not associated with, the bending portions of the fingers, and (f) a truss-receptive member fixedly secured to the handle or the like for removeably engaging said truss members for providing a no-slip grip between said gloves and the handle, the glove apparatus for protecting the hand and for enhancing the sensitivity of the dexterity of the user.

9. A glove apparatus as defined in claim 8 wherein said palm truss member is aligned to cover the vicinity of the head of the second, third, fourth and fifth metacarpal bone of the hand.

10. A glove apparatus as defined in claim 8 wherein said lower finger truss member is aligned to cover the vicinity of the shaft of the proximal phalanx of each finger.

11. A glove apparatus as defined in claim 8 wherein said intermediate finger truss member is aligned to cover the vicinity of the shaft of the middle phalanx of each finger.

12. A glove apparatus as defined in claim 8 wherein said outer finger truss member is aligned to cover the vicinity of the shaft of the distal phalanx of the second and the third finger.

13. A glove apparatus for use in weightlifting to proved engagement of the hands with a weighted device or the like comprising:

(a) one or two gloves for use on the hands, (b) a palm truss member fixedly secured to the upper portion of the palm of said gloves but displaced from, and not associated with, the bending portions of the palm, (c) a palm pad fixedly secured to the lower portions of the palm of said gloves, (d) a lower finger truss member fixedly secured to the lower portion of one or more fingers of said gloves but displaced from, and not associated with, the bending portions of the finger, (e) an intermediate finger truss member fixedly secured to the middle portion of one or more fingers of said gloves but displaced from, and not associated with, the bending portions of the finger, (f) a truss-receptive member fixedly secured to the weighted device or the like for removeably engaging said truss members for providing a no-slip grip between said gloves and the weighted device, the glove apparatus for protecting the hand and for enhancing the sensitivity of and the dexterity of the user.

14. A glove apparatus as defined in claim 13 wherein said palm truss member is aligned to cover the vicinity of the head of the second, third, fourth and fifth metacarpal bone of the hand.

15. A glove apparatus as defined in claim 13 wherein said lower finger truss member is aligned to cover the vicinity of the shaft of the proximal phalanx of each finger.

16. A glove apparatus as defined in claim 13 wherein said intermediate finger truss member is aligned to cover the vicinity of the shaft of the middle phalanx of each finger.

17. A glove apparatus as defined in claim 13 wherein said palm pad is aligned to cover the vicinity of the superficial palmer arch and the deep palmer arch.

18. A glove apparatus for use in golf to provide the secure engagement of a hand or hands with the handle of a golf club comprising:

(a) one or two gloves for use on the hands, (b) a palm truss member fixedly secured to the upper portion of the palm of said gloves but displaced from, and not associated with, the bending portions of the palm, (c) a finger truss member fixedly secured to the lower portion of one or more fingers of said gloves but displaced from, and not associated with, the bending portions of the fingers, and (d) a truss-receptive member fixedly secured to the handle of the golf club for removeably engaging said truss members for providing a no-slip grip between said gloves and the handle of the golf club, the glove apparatus for protecting the hand and for enhancing the sensitivity of and the dexterity of the user.

19. A glove apparatus as defined in claim 18 wherein said palm truss member is aligned to cover the vicinity of the head of the third, fourth and fifth metacarpal bone of the hand.

20. A glove apparatus as defined in claim 18 wherein said finger truss member is aligned to cover the vicinity of the shaft of the proximal phalanx of the second, third and fourth finger.

21. A glove apparatus as defined in claim 18 wherein said truss-receptive member comprises the handle of the golf club comprised of material removeably affixable to the said truss members.

22. A glove apparatus as defined in claim 18 wherein said truss-receptive member comprises a strip of material removeably affixable to said truss members aligned longitudinally and fixedly secured on the back of the handle and covering approximately one-third of the cross-sectional circumference of the handle.

23. A glove apparatus for use in cycling to provide the secure engagement of the hands with the handle bars of a cycle comprising:

(a) one or two gloves for use on the hands, (b) a palm truss member fixedly secured to the upper portion of the exterior of said gloves but displaced from, and not associated with, the bending portions of the palm, (c) an upper palm pad adjacent to and below said palm truss and fixedly secured to the exterior palm of said gloves but displaced from, and not associated with, the bending potions of the palm, (d) a lower palm pad adjacent to and below said upper palm pad and fixedly secured to the exterior palm of said gloves but displaced from, and not associated with, the bending portions of the palm, (e) an interior palm pad juxtaposed said lower palm pad and fixedly secured to the interior palm of said gloves but displaced from, and not associated with, the bending portions of the palm, (f) a thumb pad fixedly secured to the lower portion of the exterior thumb of said glove but displaced from, and not associated with, the bending portions of the thumb, and (g) a truss-receptive member fixedly secured to the handle bars of the cycle for removeably engaging said truss member for providing a no-slip grip between said gloves and the handle bars, the glove apparatus for protecting the hand and for enhancing the sensitivity of and the dexterity of the user.

24. A glove apparatus as defined in claim 23 wherein said palm truss member is aligned to cover the vicinity of the head of the second, third, fourth and fifth metacarpal bone of the hand.

25. A glove apparatus as defined in claim 23 wherein said upper palm pad is aligned to cover the vicinity of the proximal transverse of the palm of the hand.

26. A glove apparatus as defined in claim 23 wherein said lower palm pad and said inner palm pad are aligned to cover the vicinity of the deep palmer arch.

27. A glove apparatus as defined in claim 23 wherein said thumb pad is aligned to cover the vicinity of the proximal phalanx and the distal phalanx of the thumb of the hand.

28. A glove apparatus for use with a baseball bat comprising:

(a) a palm member secured to the glove apparatus and aligned to cover only the head portion of the second, third, fourth and fifth metacarpal bone of the hand, to be displaced from, and not associated with, the bending portions of the palm, (b) a first finger member secured to the glove apparatus and aligned to cover only the shaft of the proximal phalanx of each finger to be displaced from, and not associated with, the bending portions of the finger, (c) a second finger member secured to the glove apparatus and aligned to cover only the shaft of the middle phalanx of each finger to be displaced from, and not associated with, the bending portions of the finger, and the glove apparatus for removably engaging the baseball bat to provide a no-slip grip between the glove and the bat at each member for protecting the hand and for enhancing the sensitivity of and the dexterity of the user.

29. A glove apparatus for use in water sports with a ski handle or the like comprising:

(a) a palm member secured to the glove apparatus and aligned to cover only the head portion of the second, third, fourth and fifth metacarpal bone of the hand to be displaced from, and not associated with, the bending portions of the palm, (b) a first finger member secured to the glove apparatus and aligned to cover only the shaft of the proximal phalanx of each finger to be displaced from, and not associated with, the bending portions of the finger, (c) a second finger member secured to the glove apparatus and aligned to cover only the shaft of the middle phalanx of each finger to be displaced from, and not associated with, the bending portions of the finger, and (d) a third finger member secured to the glove apparatus and aligned to cover only the shaft of the distal phalanx of the second and third finger to be displaced from, and not associated with, the bending portions of the finger, the glove apparatus for removably engaging the handle to provide a no-slip grip between the glove and the handle at each member for protecting the hand and for enhancing the sensitivity of and the dexterity of the user.

30. A glove apparatus for use in weight training with a weighted device or the like comprising:

(a) a palm member secured to the glove apparatus and aligned to cover only the head portion of the second, third, fourth and fifth metacarpal bone of the hand to be displaced from, and not associated with, the bending portions of the palm, (b) a first finger member secured to the glove apparatus and aligned to cover only the shaft of the proximal phalanx of each finger to be displaced from, and not associated with, the bending portions of the finger, and (c) a second finger member secured to the glove apparatus and aligned to cover only the shaft of the middle phalanx of each finger to be displaced from, and not associated with, the bending portions of the finger, the glove apparatus for removably engaging the weighted device to provide a no-slip grip between the glove and the weighted device at each member for protecting the hand and for enhancing the sensitivity of and the dexterity of the user.

31. A glove apparatus for use with a golf club comprising:

(a) a palm member secured to the glove apparatus and aligned to cover only the head portion of the third, fourth and fifth metacarpal bone of the hand to be displaced from, and not associated with, the bending portions of the palm, and (b) a finger member secured to the glove apparatus and aligned to cover only the shaft of the proximal phalanx of the second, third and fourth finger to be displaced from, and not associated with, the bending portions of the finger, the glove apparatus for removably engaging the golf club to provide a no-slip grip between the glove and the golf club at each member for protecting the hand and for enhancing the sensitivity of and the dexterity of the user.

32. A glove apparatus for use in cycling with a handle bar or the like comprising:

(a) a palm member secured to the glove apparatus and aligned to cover only the head portion of the second, third, fourth and fifth metacarpal bone of the hand to be displaced from, and not associated with, the bending portions of the palm, and (b) a palm pad secured to the glove apparatus below said palm bonding member and aligned to cover only the vicinity of the proximal transverse of the palm of the hand to be displaced from, and not associated with, the bending portions of the palm, the glove apparatus for removably engaging the handle bar to provide a no-slip grip between the glove and the handle bar at said palm member for protecting the hand and for enhancing the sensitivity of and the dexterity of the user.

* * * * *